US005924593A

United States Patent [19]

Rutledge, Jr. et al.

[11] Patent Number: 5,924,593

[45] Date of Patent: Jul. 20, 1999

[54] ADJUSTABLE BRUSH BAR FOR PAINT POTS

[76] Inventors: James Leonard Rutledge, Jr., 9408 Donora Dr., Richmond, Va. 23229; John Kenneth Rutledge, 4042 Gaelic Land, Richmond, Va. 23060

[21] Appl. No.: 08/602,491

[22] Filed: Feb. 20, 1996

Related U.S. Application Data

[63] Continuation-in-part of application No. 08/338,965, Nov. 14, 1994, abandoned.

[51] Int. Cl.[6] ..... B65D 25/00

[52] U.S. Cl. ..... 220/695; 220/697; 220/699

[58] Field of Search ..... 220/697, 695, 220/699, 702, 735, 736

[56] References Cited

U.S. PATENT DOCUMENTS

| | | | |
|---|---|---|---|
| 517,293 | 3/1894 | Powell | 220/735 |
| 1,384,120 | 7/1921 | Craft | 220/697 |
| 1,700,585 | 1/1929 | Grismer | 220/697 |
| 2,184,460 | 12/1939 | Linder | 220/736 X |
| 2,196,614 | 4/1940 | Spitz | 220/697 |
| 2,452,025 | 10/1948 | Dunn | 220/697 X |
| 2,606,689 | 8/1952 | Kistner | 220/695 X |
| 2,730,266 | 1/1956 | Coursey | 220/699 |
| 3,019,939 | 2/1962 | Brown | 220/697 |
| 3,275,129 | 9/1966 | Snyder | 220/736 X |
| 3,291,337 | 12/1966 | Jenkins | 220/699 X |
| 3,593,880 | 7/1971 | Kulbacki | 220/697 |

*Primary Examiner*—Steven M. Pollard

[57] ABSTRACT

A paint brush wiper which can telescope outwardly to accommodate paint containers of various sizes and having a clamping mechanism that may be rotated to accommodate attachment to various arcuate portions of the rim. The paint brush wiper may be used with a variety of paint containers including metal paint cans, plastic paint cans, and paint pails. The wiper may be telescoped inwardly upon a central section and the clamping mechanisms may be rotated 180° to allow nesting the wiper within dead spaces between nested paint containers for shipping or storing purposes.

3 Claims, 5 Drawing Sheets

ADJUSTABLE BRUSH BAR FOR PAINT POTS

This is a continuation-in-part of U.S. application Ser. No. 08/338,965, filed Nov. 14, 1994, now abandoned, having the same title.

FIELD OF THE INVENTION

This invention relates to paint brush wiper bars, and in particular, to an adjustable wiper bar that can be collapsed in size to facilitate shipment in the bottom of paint pots that are nested in shipping cartons. This invention provides an inexpensive paint brush bar that is adjustable in size to allow its use with many different sizes of paint containers.

BACKGROUND OF THE INVENTION

Paint brush wiper bars are used to obtain an even distribution of paint on the brush and also as a convenient means to hold a brush while it is not in use. In the present state of the art, the wiper bars are not adjustable for different pot sizes and for different depths within the paint pot.

This invention provides a paint brush wiper bar that is adjustable in two dimensions, one being across the bar to accommodate different sized pots and the other being the depth that the bar is positioned within the pot. The adjustability of size across the pot combined with the ability to rotate the orientation of the clamping mechanism allows the paint brush wiper bar to be stored in the bottoms of a series of paint pots during shipment. The paint pots may be nested together to reduce size for easy shipment with no interference from the enclosed paint brush wiper bars. The paint brush wiper bar may also be a simple one-piece member of a length that will fit in the bottom of nested paint pot for inexpensive easy distribution.

SUMMARY OF THE INVENTION

One object of the invention is to provide a paint brush wiper bar that is inexpensive to manufacture. The present invention is constructed of parts that are simple to manufacture. The interacting parts are also very easily assembled to form the invention. The paint brush wiper bar may also be of one-piece construction. The paint brush wiper bar is therefore very economical to produce.

A second object of the invention is to provide a paint brush wiper bar that accommodates shipment within nested paint pails or pots. The wiper bar is easily collapsed in overall size to allow shipment within nested containers. This functionality insures that the wiper bars occupy no extra space in the cartons during shipment, thereby saving on shipping costs. By including the paint brush wiper bars with the container at the point of sale, value is added to the pots at very little cost, thereby promoting the sale of paint pots, paint, and brushes. Also, when the wiper bars are collapsed to a flattened position, they may be packaged and stacked in a box with efficient use of the space. The adjustability of the bar reduces the number of stock keeping units required by the retailer as one size fits many different sized containers.

A third object of the invention is to provide a paint brush wiper bar that is adjustable for attachment to various sized paint cans and pails. This is accomplished by the telescoping nature of the interlocking parts of the paint brush wiper.

Another object of the invention is to make the paint brush bar adjustable for placement at various depths below the rim within the paint can or pail. This allows paint to be wiped from the brush directly into the can, and not down the outside of the can or into the rim. This feature allows the rim to stay clean of paint, thereby allowing the lid to be reapplied to the can and then easily removed again when necessary. Lids can be very difficult to remove from cans having rims which have been contaminated with paint.

A further object of the invention is to provide a clamping mechanism that allows easy attachment of the paint brush wiper bar to several different types of rims that are typically encountered in the trade. The brush wiper bar is attached to a paint can by simply grasping the clamping mechanism and simply exerting an even downward force until the clamps snap lock onto the can. The paint brush wiper bar therefore adds great value to the painter by providing a bar that snaps easily onto the can, stays firmly in place, and detaches easily for cleaning, stacking of pots, or reuse.

The paint brush wiper bar makes painting easier by providing a bar to wipe the brush, a place to rest and hold the brush, and a blade to clean the brush. The wiper bar eliminates paint mess by keeping the paint off the rim, brush handle, and hands. It keeps paint inside the pot and not dripping down its outer circumference. It reduces spatter due to bristles throwing paint out. The brush bar prevents damage to valuable property such as floors, furniture, draperies, etc., by keeping the brush tip confined within the can below the rim. By keeping brushes at a downward angle, the paint brush bar forces paint to flow toward the bristle tips thereby reducing the incidence of paint clogging up into the butt of the brush. This keeps the brush flexible for longer use before cleaning. The improved paint brush wiper bar of this invention makes painting less trouble and results in a paint brush that stays cleaner and more flexible.

Other objects and advantages may be ascertained by referencing the attached description of the invention and the appended drawings.

DESCRIPTION OF THE INVENTION

Figures 1, 2:
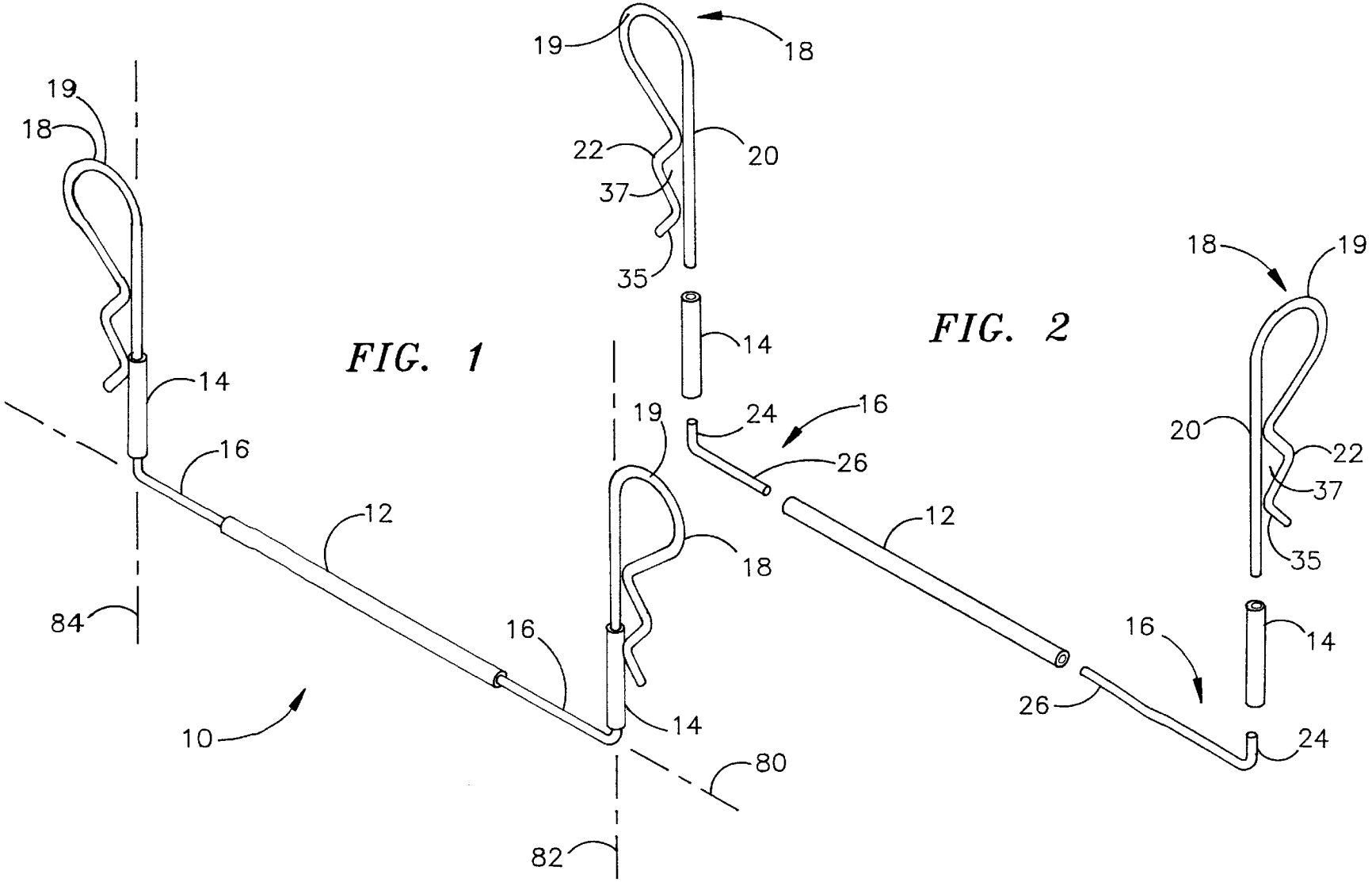
FIG. 1 is a perspective view of the paint brush wiper bar of this disclosure shown fully assembled.
FIG. 2 is an exploded view of the paint brush wiper bar showing the separate parts of the invention.

A paint brush wiper bar 10 in accordance with the present invention is shown in FIG. 1. The wiper bar consists of seven pieces that act in conjunction to form a one-piece paint brush wiper bar. The separate pieces, better shown in FIG. 2, include the central sleeve 12, side sleeves 14, corner rods 16, and clamps 18.

As shown in FIG. 2, the clamps consist of a post section 20, an angled section 22, and a bow section 19. The corner rods 16 have a short end 24 and a long end 26. The post section 20 of each clamp 18 slides into the side sleeve 14. The opposite end of each side sleeve 14 slides onto the short end 24 of the corner rod 16. The long ends 26 of corner rods 16 slide into the central sleeve 12. When fully assembled, as shown in FIG. 1, the seven sections interact to form the invention, an adjustable paint brush wiper bar 10.

Figure 9:
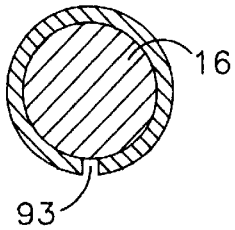
FIG. 9 is a cross-section taken on section 9—9 of FIG. 8.
Figure 8:
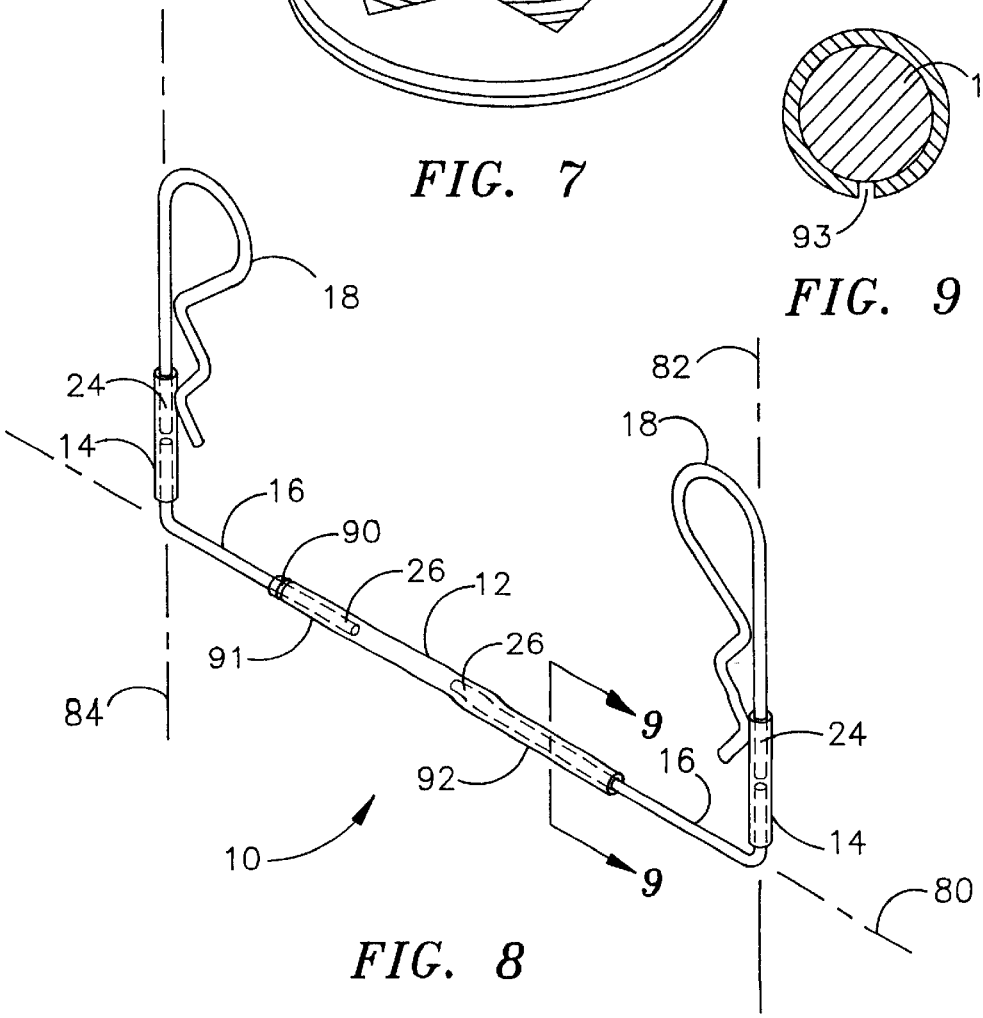
FIG. 8 is a perspective view showing the paint brush wiper bar with the clamps rotated 180° and the end rods pushed fully into the central sleeve for shipment and storage.

Both the central 12 and side 14 sleeves are sized so as to create a tight frictional fit on at least one and at least part of the inserted ends of the corner rods 16 and clamps 18. More specifically and as best seen in FIG. 8, the longer end 26 of the left corner rod 16 is shorter than the longer end 26 of the right corner rod 16. The central sleeve 12 has its left end 90 swaged or crimped to the left longer end 26 so that it is firmly held in place against rotation or sliding. The adjacent part 91 of central sleeve 12 is a tight frictional fit for approximately 0.250 inches with the end of the right larger end 26 so that if end 26 is inserted all the way into central sleeve 12 it will be held by the tight fit of 91. The right port 92 of central sleeve 12 permits an easy sliding fit for the right larger end 26. The fit between the lower end of side sleeves 14 and the sort end 24 of both corner rods 16 is a tight non-rotating and non-sliding fit. The fit between the upper end of side sleeves 14 and the clamps 18 is a tight frictional fit that permits rotation and sliding. This frictional fit allows the corner rods 16 and clamps 18 to be slidingly engaged within the sleeves. A telescoping action is therefore created between the clamps 18 and corner rods 16 by the sliding action of the post section 20 of the clamp 18 within one end of the side sleeve 14 and the sliding action of the short end 24 of the corner rod 16 within the opposite end of the side sleeve. Likewise, a telescoping action is created by the frictional fit of the long ends 26 of the corner rods 16 in each end of the central sleeve 12. This telescoping action therefore allows lengthening of the chord of the paint brush wiper bar across the opening of the bucket by virtue of the sliding action of the long ends 26 of the corner rods 16 within the central sleeve 12 and also allows adjustment of the depth of the wiper bar within the bucket by virtue of the sliding action of the post section 20 of the clamps 18 and the short ends 24 of the corner rods 16 within the side sleeves 14. The corner rods 16 and clamps 18 are typically 0.093 and 0.091 inches in diameter, respectively, and the outer diameter of the sleeves 12 and 14 are typically 0.170 and 0.155 inches, respectively. The sleeves are typically split metal tubes as seen in FIG. 9 which is a cross section taken along 9—9 of FIG. 8. The split 93 of the sleeve is shown. The clamps 18 may rotate 360° with respect to the side sleeves 14.

As shown in FIGS. 1 and 8, the wiper bar 10 is adjustable in length along axis 80 to accommodate paint cans, pails, etc. of various widths. The clamps of wiper bar 10 are angled outward about 110° to allow the wiper bar to conform to the shape of various pails, from those with true vertical sides to those with sloping sides.

Figure 3:
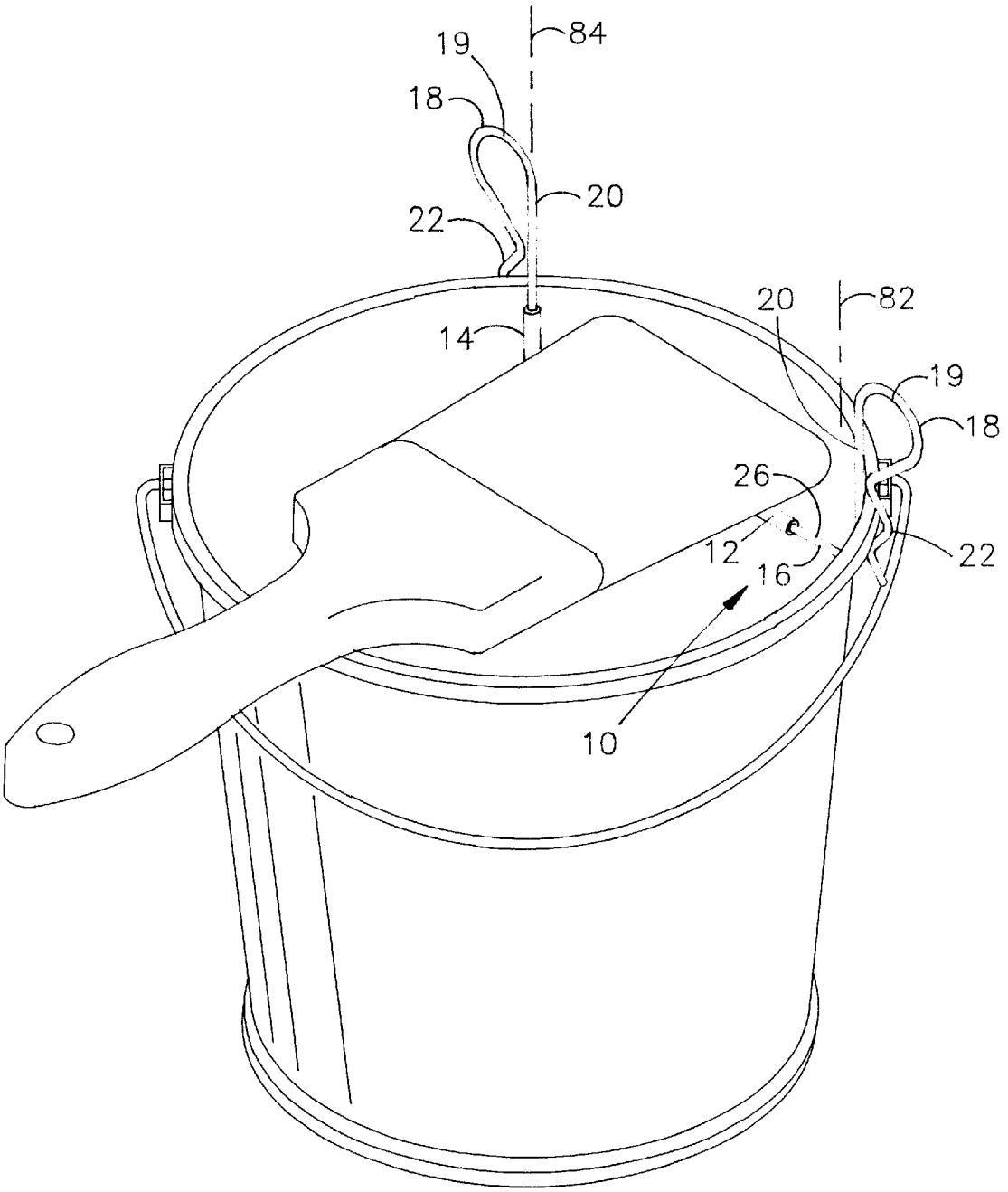
FIG. 3 is a perspective view of the paint brush wiper bar attached to a plastic paint can and showing a paint brush resting on the bar.

The wiper bar 10 in FIG. 1, is adjustable in length along axes 82 and 84 which extend through the center of the post section 20 of clamps 18, to extend the depth at which the wiper bar 10 is situated within the pail or can. The clamps 18 also may be rotated around axes 82 and 84 to allow attachment to the paint pail at various positions which is preferably offset from the center of the paint pail opening, depending on the desires of the person using the wiper. These adjustments are better shown in FIG. 3 where the wiper is near one side of the paint pail and down inside to a depth greater than the thickness of the brush. The bristles of the brush touch the side of the can. In this position the brush is in effect wedged inside the pail in a stabilized position that permits movement of the pail without the brush falling away. The paint brush depth within the pail may be adjusted by increasing or decreasing the overlap by which the post sections 20 of clamps 18 extend within the side sleeves 14. The length of the wiper bar 10 across the pail opening may be changed by adjusting the extension of the right end 26 of the corner rods 16 within the central sleeve 12. If the wiper bar 10 is canted toward one side of the pail, then post sections 20 of clamps 18 may be rotated around axes 82 and 84 to accommodate a secure fit against the arcuate side of the pail.

Figure 4:
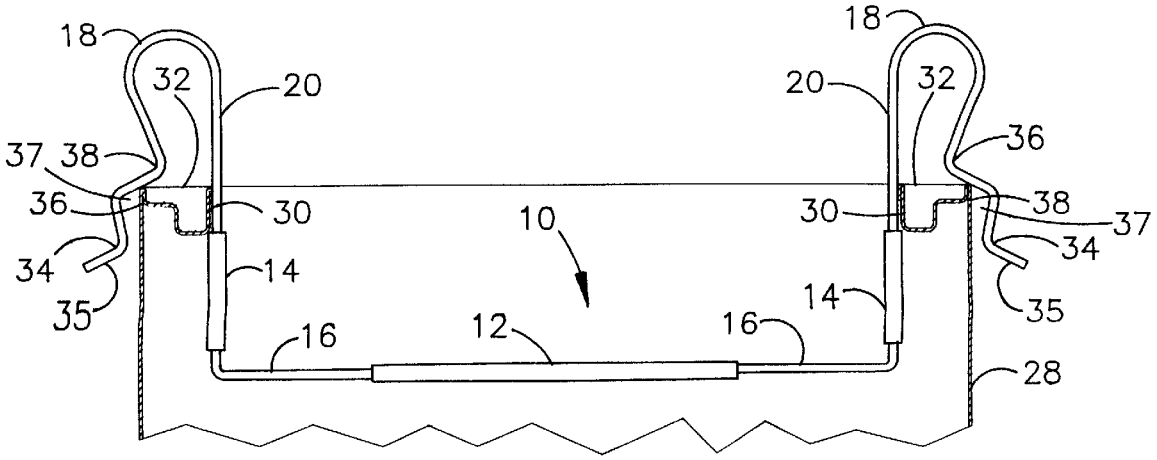
FIG. 4 is a cutaway view of the paint brush bar in use with a metal paint can.
Figure 5:
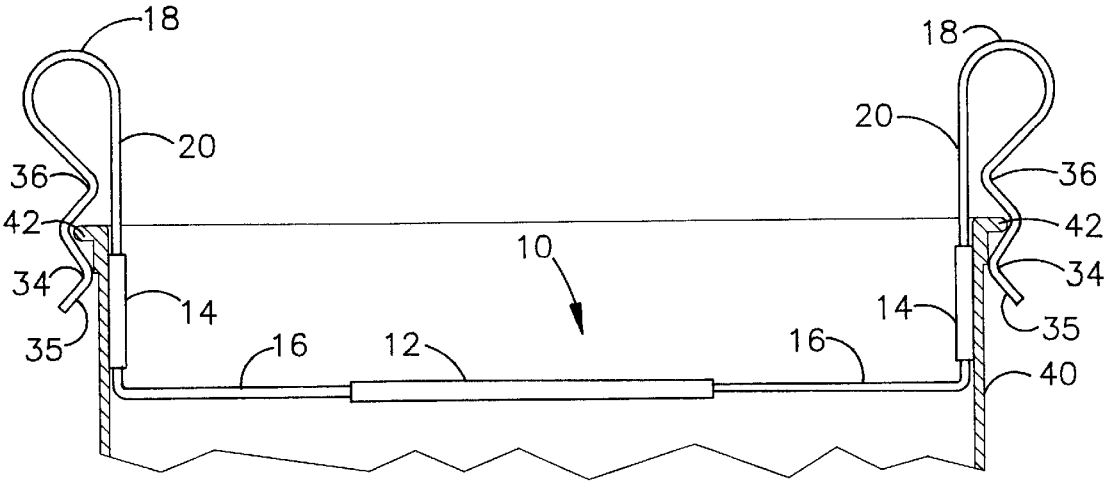
FIG. 5 is a cutaway view of the paint brush bar in use with a plastic paint can.
Figure 6:
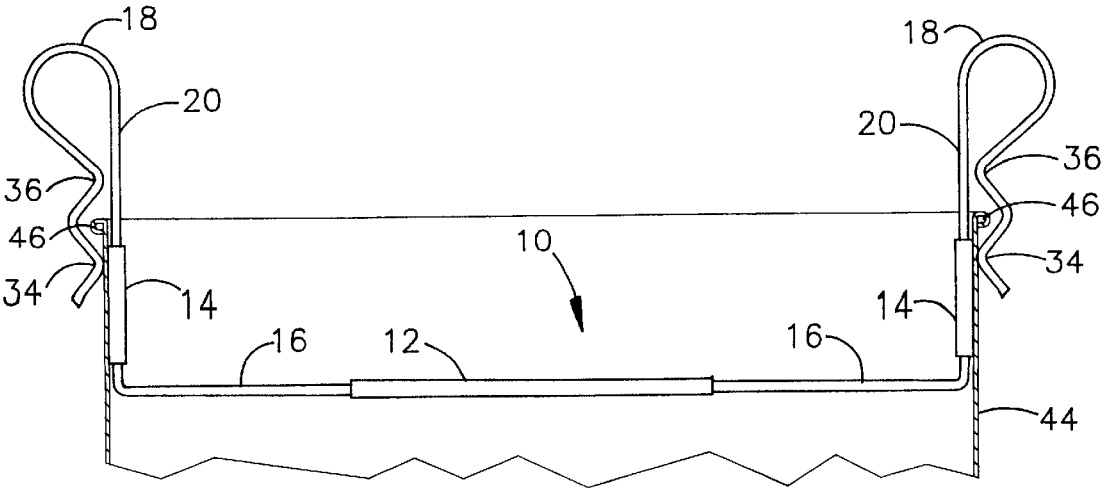
FIG. 6 is a cutaway view of the paint brush bar in use with a paint pail.

FIGS. 4, 5, and 6 are a cutaway views of the paint brush bar 10 demonstrating its use with several typical types of paint containers that are currently used in the industry. FIG. 4 shows the paint brush wiper bar 10 used with a metal paint can 28. The bow 19 in the clamps 18 serves as both a handle and a spring. To affix the wiper bar to the can, the bar 10 is grasped by the bows 19 and pushed onto the top of the paint can. The first bend 34 in the angled section 22 forms flared out surface 35 which will first contact the rim. Surface 35 of the clamp is outward with respect to the can rim and this causes frictional resistance as the bar is pushed onto the rim forcing the clamp 18 apart. But as the bar is advanced further the outer edge of the rim contacts the first bend 34 of the clamp 18 and the frictional resistance of surface 35 is overcome and it no longer resists downward movement of the bar with respect to the can. The clamps 18 then rapidly advance until the outer edge of the rim rests in the open space 37 created by the first and second bends in the angled side 22 of the clamps. The clamps 18 are spread apart until post section 20 of clamp 18 is flush with the inner lip 30 of the rim 32 at the top of the can. When clamped in position on the paint can, the bow 19 portion of the clamps 18 form a handle portion high above the metal rim of the can, allowing ample area for grasping the protruding clamps.

The paint brush bar 10 may be removed from the metal paint can 28 whenever desired by simply grasping the protruding bow 19 or the clamp 18 and pulling upwards until the force of the spring steel against the rim 32 at the first bend 34 is overcome.

FIG. 5 is a cutaway view of the paint brush bar 10 in use with a plastic paint can 40. Although the rim 42 is an outwardly extending portion of the plastic container, the bar 10 is applied and removed from the plastic paint can 40 in a manner analogous to the metal paint can of FIG. 4. When fully installed on the plastic paint can 40, the outward extending rim 42 of the plastic can 40 is positioned securely within open space 37, between the first 34 and second 36 bends of the angled side 22 of clamps 18.

FIG. 6 is a cutaway view of the paint brush bar 10 in use with a paint pail 44. The rim 46 of the paint pail 44 is a rolled over portion of the top of the pail that extends outwardly. The bar 10 is applied and removed from the pail 44 in a manner analogous to the metal paint can of FIG. 4 and the plastic paint can of FIG. 5. When fully installed on the tin pail 44, the rolled over portion that is the rim 46 is positioned securely within open space 37.

Figure 7:
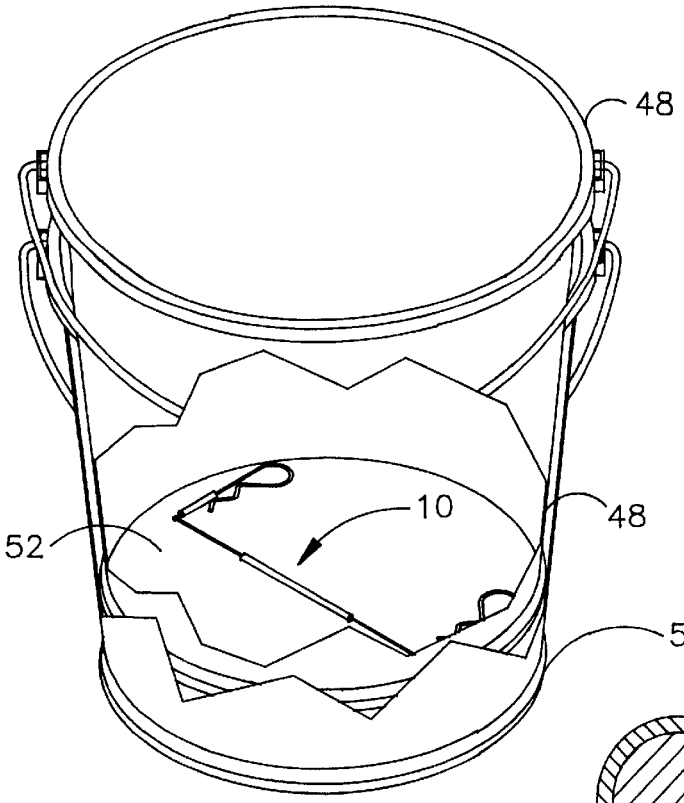
FIG. 7 is a perspective view of two paint pails nested for shipping and showing the outline of the topmost pail and the outline of the brush bar stored in the air space between the nested pails.

FIG. 7 is a perspective view of two paint pails nested for shipping and showing the outline of the topmost pail 48 and the outline of the brush bar 10 stored in the dead space 52 between the nested pails. To fit the paint brush bar 10 within the dead space 52 between the topmost 48 and bottommost 50 pail, the paint brush bar 10 may be telescoped to its shortest overall length by pushing the long ends 26 of corner rods 16, as shown in FIG. 8, as far as possible into central sleeve 12. The bar 10 can also be collapsed to a flat and shorter configuration by rotating the clamps 18 180° around axes 82 and 84 as shown in FIG. 8, so that the post section 20 of clamps 18 are positioned toward the outside of the paint pails and the angled section 22 of clamps 18 are positioned toward the interior of the paint pails, thereby facilitating a better fit within the dead space 52 between the pails.

Several embodiments of the seven-piece paint brush wiper bar are possible. The brush wiper bar may also be formed as a one-piece, three-piece, or five-piece embodiment.

In the one-piece embodiment a single piece of spring steel or similar material is formed into a central wiping portion for the brush and clamping portions at the ends. This embodiment has a fixed dimension and cannot be adjusted for different sized pots.

Figure 11:
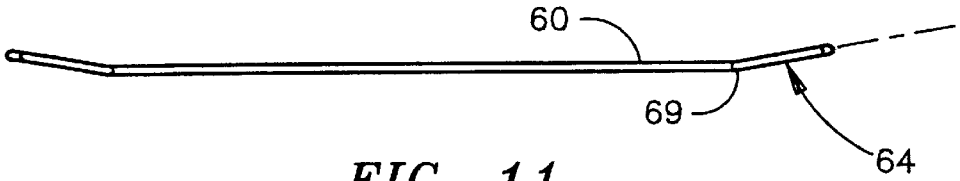
FIG. 11 is a plan view of the brush bar of FIG. 10.
Figure 12:
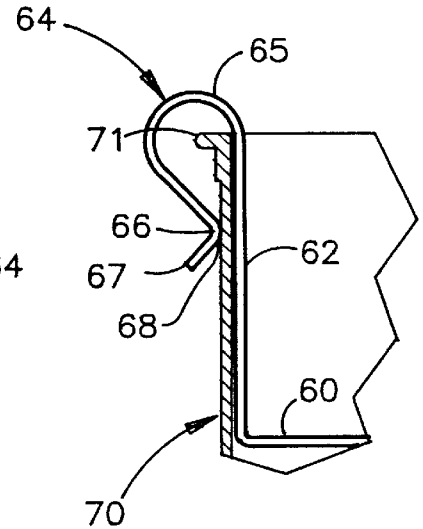
FIG. 12 is a partial section view showing one end of the brush bar of FIG. 10 clamped to the rim of a paint pail.
Figure 10:
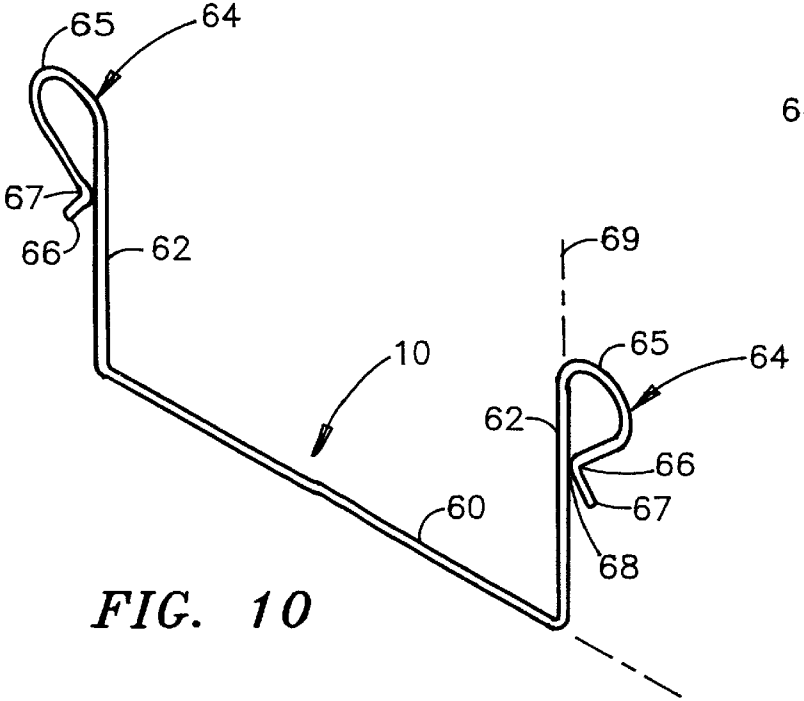
FIG. 10 is a perspective view of a one piece brush bar.

A preferred embodiment of the one-piece brush wiper bar is shown in FIGS. 10 to 13. With reference to FIG. 10, there is presented a one piece wiper bar 10 having a center section 60 for spanning the chord of a paint pail. The center section 10 has an upright post section 62 at each end to suspend the center section of the bar into a paint pail as seen in FIG. 12 at a level the bristles of a paint brush may rest thereon or the bristles may be wiped of paint with the paint remaining in the can. Each of the two post sections are integral with a clamp section 64 which clamps the wiper bar to the rim of a paint pail 70. Each clamp section 64 has a bow 65 made from the same piece of wire which is integral with a bend 66 that in turn is integral with an outwardly turned flared end 67. The bow 65 provides a space to clear the rim 71 of the pail and also serves as a spring. The flared end 67 permits the wire clamp to be sprung outward to clear the rim 71 of the pail. After clearing the rim, the bow causes the bend 66 to spring back toward the sidewall of the pail 70 to clamp the wiper bar in place. There is a space 68 between the bend 66 and the post 62. The posts 62 flare slightly outward with each post having an axis 69. This flare approximates the taper of the walls of the paint pail 70 in the vicinity of the chord bridged by the wiper bar. The clamp section 64 is angled slightly away from the center section 60 about the axis 69 as seen in FIG. 11 and towards the near side of the paint pail in order to provide a fit that is closer to the radius of the paint pail in the vicinity of where the wiper bar is clamped to the pail. The one-piece wiper bar 10 when positioned on the pail supports a brush similar to FIG. 3.

The paint pail 70 used with the wiper bar is preferably a plastic pail having an inside diameter at the top of approximately 8 inches and an inside diameter at the bottom of approximately 6¾ inches so the walls of the pail taper outwardly and upwardly. This permits a number of the pails to nest with one another, similar to FIG. 7. The preferred pail is approximately 6¾ inches in height with a dead space between nested pails of approximately 1 inch. This dead space is the distance from the inside bottom of one pail to the outside bottom of the pail just above it.

Figure 13:
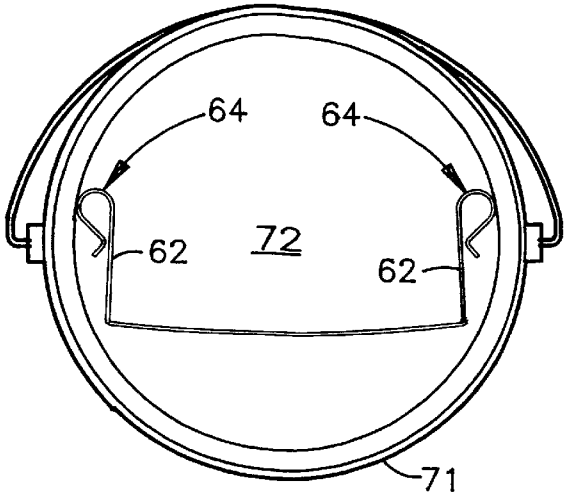
FIG. 13 is a plan view showing the brush bar of FIG. in the bottom of a paint pail.

As seen in FIG. 13, the maximum length of the one-piece wiper bar is approximately the inside diameter of the bottom 72 of the preferred pail. The length of the bar is preferably slightly longer so that it provides a friction fit at the bottom. The actual bar is approximately 7 inches in overall length with the center section 60 approximately 6 inches long. The post sections are approximately 1½ inches deep with the bow 65 being about ⅜ of an inch wide and the space 68 about 3/16 of an inch. Thus, the chord of the top of the pail spanned by the wiper bar is about 1½ inches from the near side of the pail. The chord length is approximately the inside diameter of the bottom of the pail.

The one-piece wiper bar 10 of FIGS. 10 to 13 is preferably made of a single piece of bent galvanized steel wire whose diameter is 0.032 of an inch. Alternatively, it could be made of other suitable materials including plastics.

An important feature of the invention is the ability of the one-piece wiper bar of FIGS. 10 to 13 to be placed in the dead space between nested pails for distribution in paint stores an the like. This combination of a highly functional and usable wiper bar of minimal cost that can be so packaged with paint pails for minimal cost and convenience is an elegantly simple solution to a widespread need. The placement in the bottom of FIG. 10 only shows a single pail but in use multiple pails would be nested for distribution as in FIG. 7. A variation of the wiper bar of FIGS. 10 to 13 would be a bar that had a telescoping ferrule or sleeve with a friction fit in the center section 60 so that the length of the wiper bar could be adjusted.

The three-piece brush wiper bar consists of a central sleeve and two end pieces which form the clamps. The length of the three-piece brush wiper bar may be adjusted for different size openings across the face of an open paint container.

The five-piece brush wiper bar consists of a central rod, two side sleeves, and two clamps. The central rod is bent near each end and enters each side sleeve in a tight fit. The clamps enter the opposite end of the side sleeves also in a frictional fit. The five-piece brush wiper bar is fixed in the size of opening it may attach to, but by virtue of the sliding engagement of the clamps and central bar with the side sleeves, can be adjusted to different depths within the paint container.

Having thus described the invention, it is to be understood that the invention is not so limited by the description herein but is defined as follows by the appended claims.

What is claimed is:

1. A paint brush wiper and a tapered paint pail comprising:

a tapered paint pail having a bottom, tapered side walls and an open top surrounded by a rim, a paint brush wiper of a length approximately the inside width of said bottom of said paint pail and having a center section having two L shaped ends, one leg of each of said L shaped ends being received within a hollow central sleeve member, at least one of said legs being slideably recieved within said hollow central sleeve member, one of said legs recieved within said hollow central sleeve member being longer than the other, said center section being ends adapted to span a chord of said paint pail at a level below said rim of said paint pail, said slidable attachment allowing for adjustment of the overall width the paint brush wiper;

side post sections extending from each of said L shaped ends of said center section adapted to extend above the rim of said paint pail in the form of an open bow that is of spring material which provides a spring action; and clamps that are an extension downward of said open bow of said side post sections formed of spring material having a bend to fit beneath said rim with a clamping action for accommodating said rim of said paint pail, and a terminus angled outward to form an angled entrance to assist placing said paint brush wiper over said rim of said paint pail.

2. The paint brush wiper and tapered paint pail of claim 1 in combination with at least two nested paint containers with said paint containers having a dead space between the inside portion of a bottom container and the container directly above it, and said paint brush wiper inserted therein in said dead space.

3. The combination of claim 1 wherein said open bow and said clamp are angled away from said center section.

* * * * *